US006293207B1

(12) United States Patent
Do

(10) Patent No.: US 6,293,207 B1
(45) **Date of Patent: *Sep. 25, 2001**

(54) ATM BOX OR SAFE WITH CONCEALED HINGES AND ELECTRONIC LOCK

(75) Inventor: Cuong D. Do, Woodland Hills, CA (US)

(73) Assignee: Citicorp Development Center, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/370,623

(22) Filed: Aug. 6, 1999

Related U.S. Application Data

(63) Continuation of application No. 08/975,176, filed on Nov. 20, 1997, now Pat. No. 6,000,348.

(51) Int. Cl.[7] ..... E05G 1/04
(52) U.S. Cl. ..... 109/59 R; 109/64; 70/118
(58) Field of Search ..... 70/118, 119, 278, 70/279, 283; 109/59 R, 58, 64, 73–80; 292/32–36

(56) References Cited

U.S. PATENT DOCUMENTS 3,426,707 * 2/1969 Heyl et al. ..... 109/59 R
4,145,978 * 3/1979 Johnson et al. ..... 109/59 R
4,158,337 * 6/1979 Bahry et al. ..... 109/59 R
4,266,488 * 5/1981 Markham ..... 109/59 R
4,446,798 * 5/1984 Withington ..... 109/59 R X
4,534,192 * 8/1985 Harshbarger et al. ..... 109/59 R X
4,649,833 * 3/1987 Cummins ..... 109/59 R X
4,679,415 * 7/1987 Spratt ..... 109/59 R X
4,683,732 * 8/1987 Beattie ..... 109/59 R X
5,088,776 * 2/1992 James ..... 109/59 R X
5,280,755 * 1/1994 Batur ..... 109/59 R
5,341,752 * 8/1994 Hambleton ..... 109/59 R
5,778,708 * 7/1998 Crosby et al. ..... 109/59 R X
5,931,104 * 8/1999 Horn et al. ..... 109/59 R
5,970,890 * 10/1999 Harry et al. ..... 109/59 R X
6,000,348 * 12/1999 Do ..... 109/59 R

* cited by examiner

*Primary Examiner*—Suzanne Dino Barrett
(74) *Attorney, Agent, or Firm*—Blakely Sokoloff Taylor & Zafman

(57) ABSTRACT

A security enclosure with an electronic lock, a concealed hinge door and lock wheel which operates a lock internal to the security enclosure. The electronic lock operates by a key pad into which a required security code may be entered. When the correct code is entered, a solenoid within the enclosure retracts moving a pin which allows the lock wheel to rotate. When the lock wheel is rotated, strike bolts extending into the top and bottom of the enclosure and left and right strike bars extending to the sides of the enclosure are retracted enabling the door to be pulled open. The door construction is such that there are no external hinges which may be drilled out, and the door itself is recessed so that it cannot be pried open. Attempts to turn the lock wheel when the solenoid is engaged have no effect because the wheel cannot be turned without breaking.

8 Claims, 4 Drawing Sheets

ATM BOX OR SAFE WITH CONCEALED HINGES AND ELECTRONIC LOCK

This application is a continuation of Ser. No. 08/975,176 filed Nov. 20, 1997 now U.S. Pat. No. 6,000,348.

BACKGROUND OF THE INVENTION

1. Field of the Invention

The invention relates to an enclosure for housing an automatic teller machine or other component requiring a high degree of security against unauthorized entry.

2. Description of the Prior Art

Automatic Teller Machines (ATM) necessarily store large amounts of cash and are installed in locations which make them readily accessible to customers. Such ease of access coupled with physical locations in shopping malls, building lobbies and the like which may have minimal foot traffic at night and on weekends can make such machines an easy target for the theft of their contents unless good security measures are undertaken. Another requirement of an ATM is that its contents be readily accessible to authorized personnel who must on a regular basis replenish the supply of cash and service electronic and mechanical equipment within the ATM. Thus, the security measures taken must allow easy access to authorized personnel.

Various approaches have been taken to meet these challenges. For example, in U.S. Pat. No. 5,222,445, a secure enclosure for housing an ATM is provided in which a section expands from a closed position to an expanded position when access into the enclosure is needed for servicing. The purpose of such construction is to provide an ATM machine which can be installed in a relatively small space and yet provide an enclosed secure maintenance area when needed, but which does not take up space when not needed. Other techniques for providing access to the contents of an ATM to authorized personnel while maintaining some level of security are disclosed in the following U.S. Patents:

| | |
|---|---|
| 4,911,087 | Self Banking Kiosk |
| 5,299,511 | Bellcrank Assembly for Moving an ATM Module |
| 4,577,562 | Teller Machine Enclosure |
| 5,036,779 | Automatic Teller Machine Enclosure |
| 5,379,704 | Service Access System for Automatic Teller Kiosk |
| 4,681,044 | Access Door System |
| 4,557,352 | Apparatus and Method for Drive-Up Banking |
| 5,222,445 | Automatic Teller Machine Maintenance Enclosure |

However, the prior art typically relies upon existing safe technology for securing the contents of an ATM such as a combination or key lock, both of which can be compromised relatively easily by an experienced thief having knowledge of the security techniques employed in safes. It should be noted that ATM safes are relatively small when compared with bank vaults which can have much greater security measures since vaults can be located in much more secure environments as they do not need to be located so as to provide easy access by customers.

Locks on such relatively small safes can be attacked in numerous different ways depending upon the specifics of the lock because at least some of the lock elements, by necessity, are exposed.

SUMMARY OF THE INVENTION

The present invention seeks to overcome security issues inherent in safes of the type which may be used in association with an ATM. Specifically, the present invention utilizes an electronic lock, a concealed hinge door and a lock wheel which operates strike bolts & strike bars internal to the safe or ATM. The electronic lock operates by a key pad into which a required security code may be entered. When the correct code is entered, a solenoid within the electronic lock retracts allowing the lock wheel to rotate. When the lock wheel is rotated, strike bolts extending into the top an d bottom of the enclosure and left and right strike bars extending to the sides of the enclosure a re retracted enabling the door to be pulled open. The door construction is such that there are no external hinges which may be drilled out, and the door itself is recessed so that it cannot be pried open. Attempts to turn the lock wheel when the solenoid is engaged have no effect because the wheel cannot be turned without breaking.

DETAILED DESCRIPTION OF THE INVENTION

Figure 1:
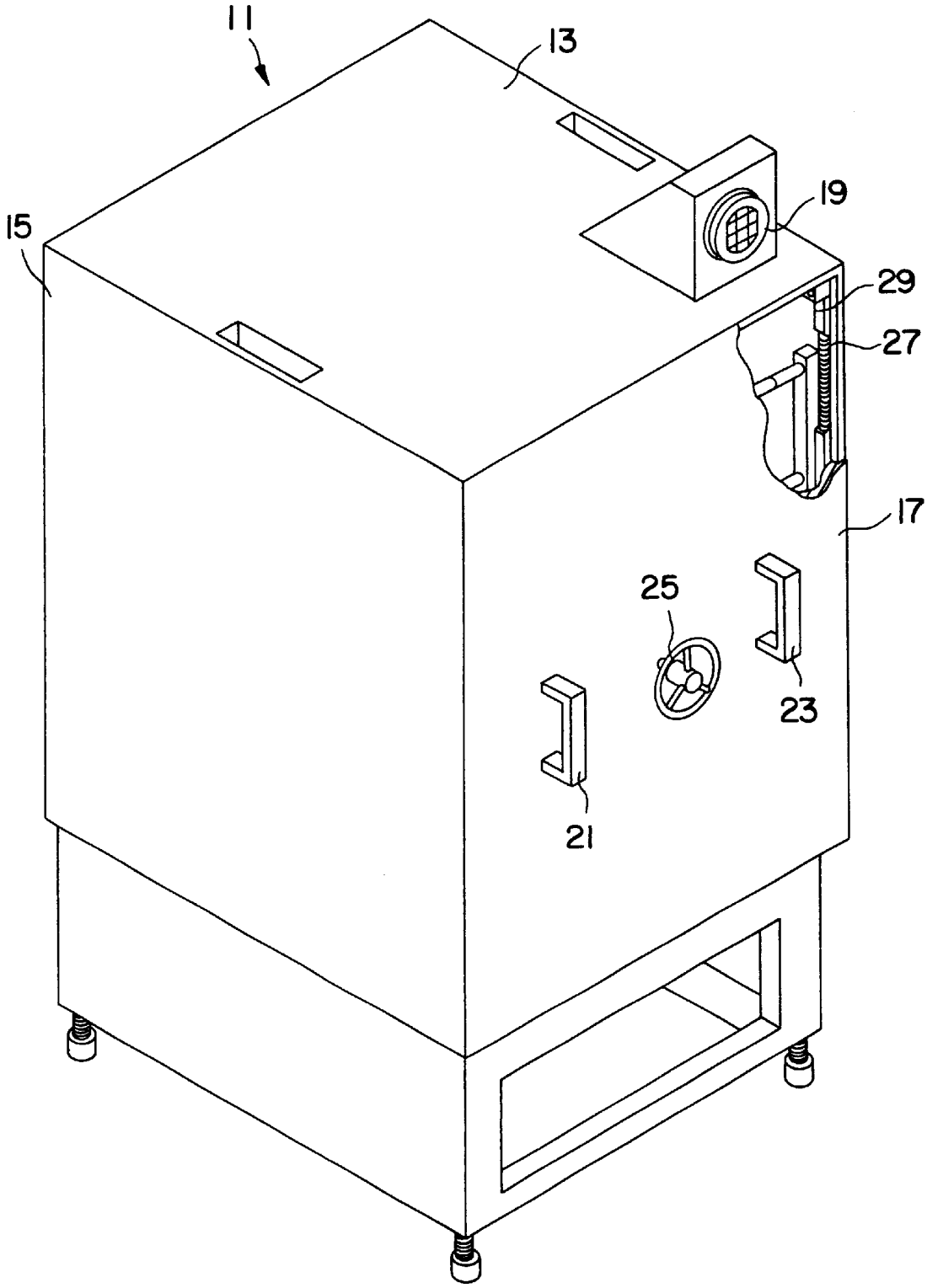
FIG. 1 is a perspective view of the invented secure enclosure with the door in a closed and locked position.

FIG. 1 shows the invented enclosure 11 including top 13, sides 15 (only one is shown) and door 17. Also shown is key pad 19, handles 21 and 23 and lock wheel 25.

Also shown in FIG. 1 in partial cut away is a portion of strike bar 27, engaging flange 29, where flange 29 extends around the periphery of door 17, and strike bar 27, which extends over most of the length of the portion of flange 29 which extends along the side of door 17. When door 17 is in a closed position as shown in FIG. 1, all of its edges are recessed between sides 15, top 13 and the bottom (not shown) of the enclosure. There are no external hinges, and the gap between the edges of the door and the sides, top and bottom of the enclosure fit with a tight tolerance making it extremely difficult or impossible to pry the door open when the locking mechanism is engaged. That is, a crow bar or the like which could generate a force sufficient to pry open the door would be too thick to fit into the small gap between the door and top, sides or bottom of the enclosure. Handles 21 and 23 are used to pull door 17 out and away from the enclosure once the enclosure has been unlocked by entering a proper security code on key pad 19 and rotating lock wheel 25 to disengage the strike bolts and strike bars as described below with reference to FIGS. 2 and 3.

Figure 2:
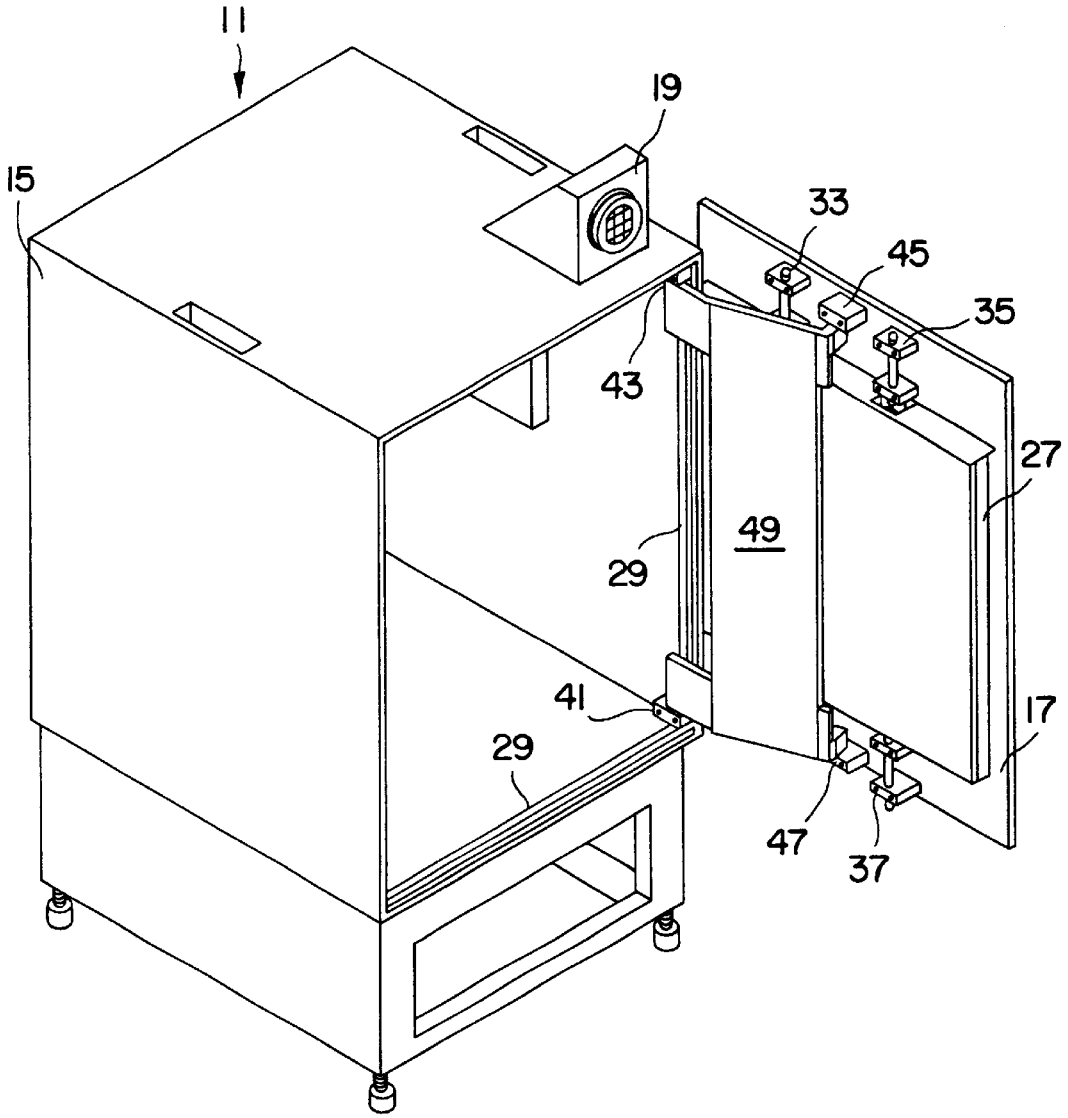
FIG. 2 is a perspective view of the invented secure enclosure with the door in an open position

FIG. 2 shows the enclosure with door 17 in an open position. Also shown in FIG. 2 are top strike bolts 33 and 35. There are also a corresponding pair of bottom strike bolts although only one bottom strike bolt 37 is shown. Strike bar 27 is shown in a retracted position. There is a second strike bar on the opposite side which is not shown in FIG. 2. Door 17 opens and pivots on enclosure hinge blocks 41 and 43 and door hinge blocks 45 and 47. That is, when door 17 is in open position as shown in FIG. 2, it rotates on hinges 45 and 47. Additionally, plate 49 rotates on hinges 41 and 43. Flange 29 is shown extending the length of the enclosure and across the width of the enclosure. Flange 29 also runs up the side opposite the side shown in FIG. 2 and along the top of the enclosure. In this manner, the strike bars and strike bolts, when extended, engage flange 29 to thereby hold door 17 in a closed position.

It should be noted that door 17 and enclosure hinges 45 and 47, and hinge blocks 41 and 43 are symmetrical. For this reason, door 17 can be mounted so that it opens to the right of enclosure 11 as shown in FIG. 2, or it may open to the left of the enclosure by placing hinge blocks 41 and 43 on the opposite side of the enclosure and rotating plate 49 180° degrees.

Figure 3:
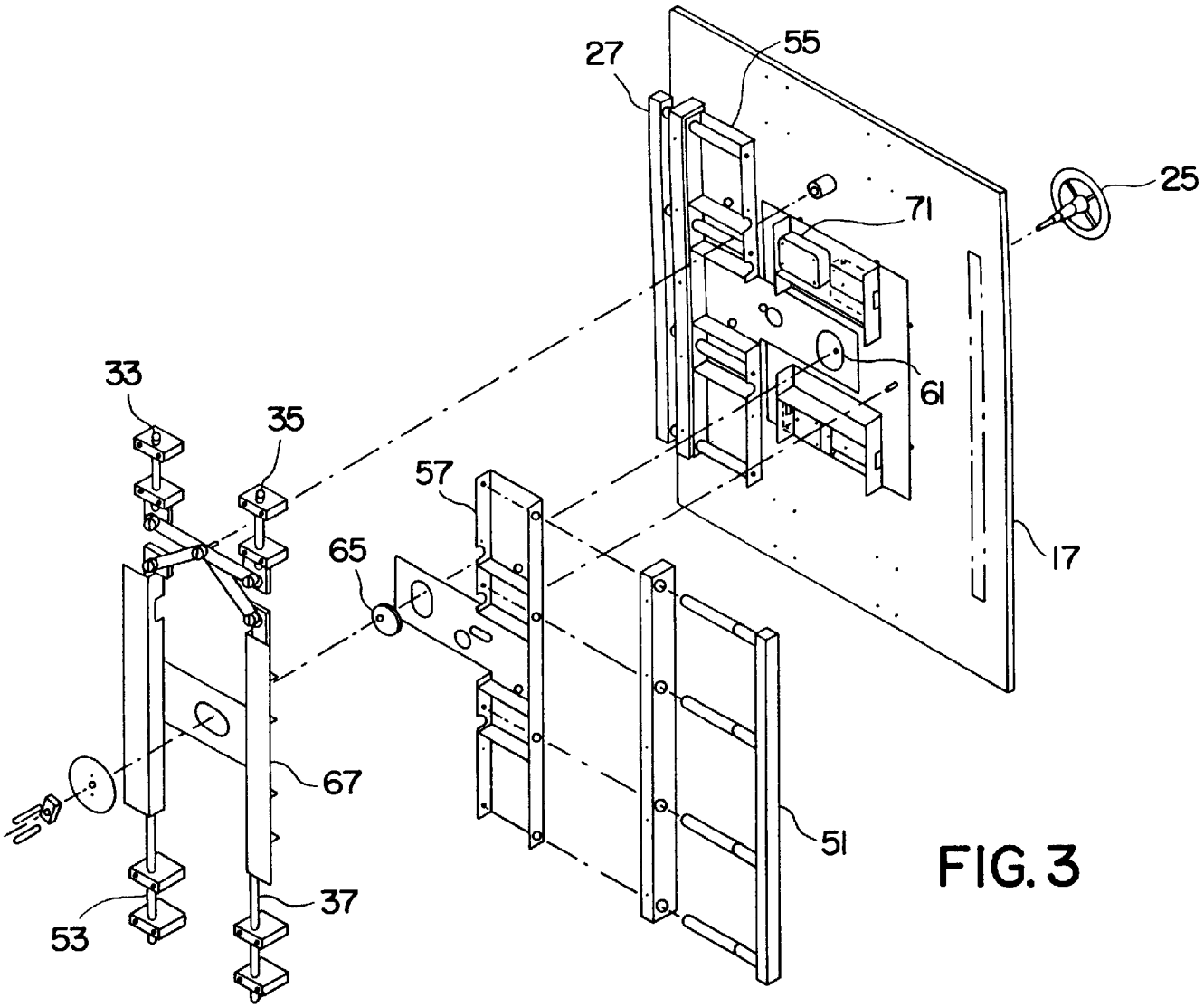
FIG. 3 is an exploded view of the door assembly showing the wheel and door locking mechanisms.

Referring now to FIG. 3, an exploded view of the locking mechanism, strike bars 27 and 51 and strike bolts 33, 35, 37 and 53 are shown. Strike bar 27 is operated by left carry bar assembly 55. Strike bar 51 is operated by right carry bar assembly 57. Rotation of cam 61 causes carry bar assembly 55 and carry bar assembly 57 to move in an outward direction or in an inward direction, depending on the position of cam 61, which causes strike bars 27 and 51 to extend and retract to, respectively, engage and disengage flange 29 (not shown in FIG. 3). Cam 61 is coupled to locking wheel 25 by an axle such that when wheel 25 is rotated, cam 61 also rotates. The particulars of the operation of the cam, assemblies 55 and 57 and wheel 25 should be readily apparent to persons skilled in the art.

In a similar manner, cam 65 causes lock slide assembly 67 to move strike bolts 33 and 35, and strike bolts 53 and 57 upward and downward together. That is, when strike bolts 33 and 35 move in an upward direction, strike bolts 53 and 37 move in a downward direction, and when strike bolts 33 and 35 move in a downward direction, strike bolts 53 and 37 move in an upward direction. Cams 61 and 65, assemblies 55, 57 and 67 are coupled together so that when wheel 25 is rotated in a first direction, strike bars 27 and 51 move inward, strike bolts 33 and 35 move downward and strike bolts 53 and 37 move upward to thereby disengage the locking mechanism. Similarly, when lock wheel 25 is rotated in an opposite direction, strike bars 27 and 51 move outward, strike bolts 33 and 35 move upward and strike bolts 53 and 37 move downward which locks door 17 in a closed position. In this manner, a rotation of 180° of wheel 25 can either lock or unlock door 17. of course, other mechanisms could be employed to move strike bars 27 and 51 and strike bolts 33 and 35, 37 and 53 into their locked and unlocked position. For example, wheel 25 could be coupled to a set of gears which rotate to perform the desired functionality. Additionally, although FIG. 3 shows four separate locking mechanisms, in other embodiments, only one, two or three locking mechanisms may be needed.

The specifics of such locking mechanisms are not important for practicing the invention. The only required elements are 1) an internal locking mechanism to maintain the door of the enclosure in a closed position until the internal locking mechanism is disengaged; 2) a device such as lock wheel 25 which rotates, slides or otherwise moves between a locking position and an unlocking position so as to disengage and engage the internal locking mechanism; and 3) a mechanism to ensure that wheel 25 or its equivalent cannot be moved or rotated except by authorized personnel.

Figure 4B:
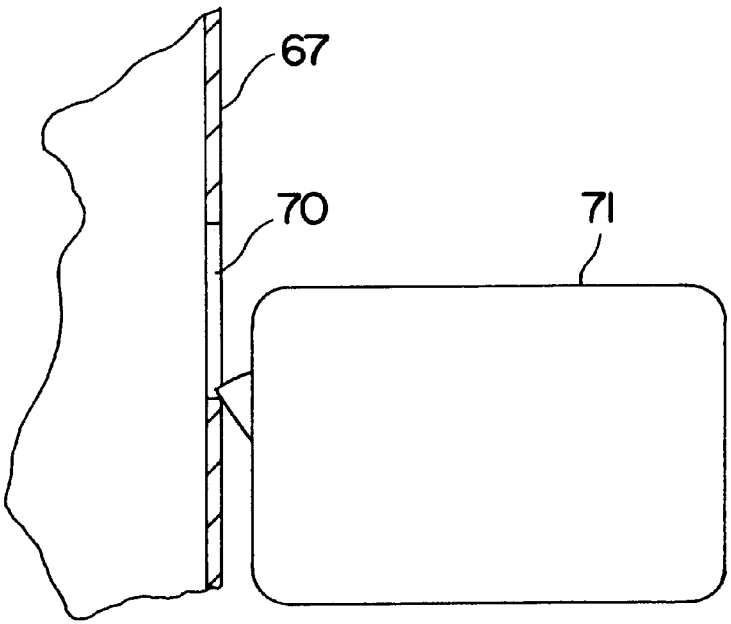
FIG. 4 is a detailed view of a locking mechanism for the wheel.
Figure 4A:
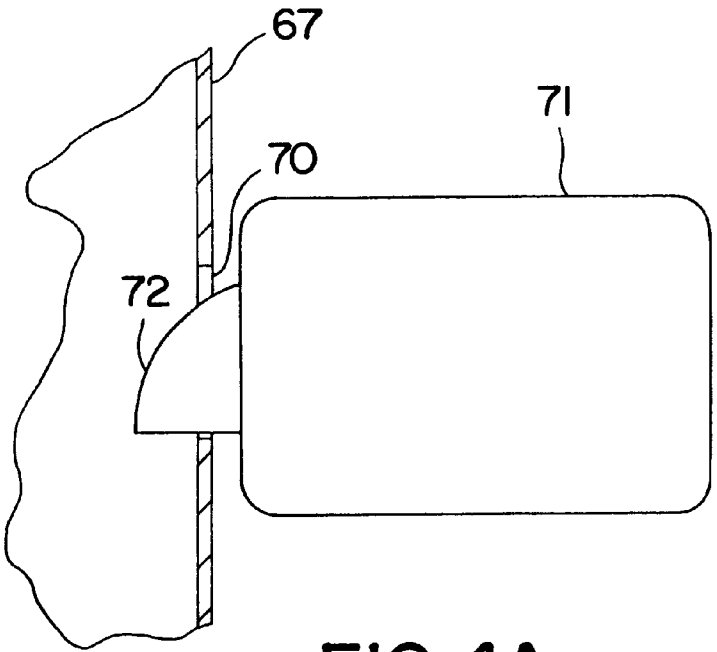

Required elements 1) and 2) have been described with reference to FIGS. 1 and 2. Required element 3) of the present invention, i.e., the mechanism to ensure that wheel 25 or its equivalent cannot be moved or rotated except by authorized personnel may be implemented, as shown in FIGS. 3 and 4, by a notch 70 on the lock slide assembly 67 and the electronic lock 71. In the locking position, a spring latched lock pawl 72 engages the notch 70 in the lock slide assembly 67 jamming the movement of the lock wheel 25. When the proper security code is entered, suitable logic applies power to the solenoid inside the lock 71 to disengage the pawl 72 allowing the lock slide assembly 67 and thus the entire boltwork to be moved to the unlocking position by rotating the lock wheel 25.

The combination of electronic key pad 19 and lock 71 is commercially available. The lock 71 is designed to accept a proper security code from the keypad 19. Only when the correct security code is entered in the keypad 19 will the lock 71 apply power to retract an internal solenoid to free the spring loaded pawl 72. The details of logic and circuitry which operate the solenoid are well known to persons skilled in the field of the invention.

When the lock wheel is rotated to the locking position, the lock pawl 72 relatches the notch 70 in lock slide assembly 67.

Another mechanism which could be used to perform the same function as the solenoid is a geared motor which retracts and releases the pawl linearly.

I claim:

1. A security enclosure and locking mechanism comprising:

an input mechanism external to the enclosure having means for generating an electrical signal when a predetermined code is entered;

a first locking mechanism internal to the enclosure electrically coupled to the input mechanism, said first locking mechanism comprising a pawl, said pawl being one of engaged and disengaged depending on a state of said electrical signal; and a second locking mechanism having a first portion internal to the enclosure and coupled to the first locking mechanism and a second portion external to the enclosure, said first portion being adapted to lock and unlock a door to said security enclosure depending on a position of the second portion;

said security enclosure includes a top side, a bottom side, a left side and a right side, a front facing surface and a rear facing surface, and said door has a top edge, a bottom edge, a left edge, a right edge, an inside surface and an outside surface;

said first portion of said second locking mechanism includes a latching means for securing the door to the security enclosure;

said latching means comprising at least two strike features, said at least two strike features lock said door to at least two sides of said security enclosure;

said first locking mechanism and said first portion of said second locking mechanism, coupled to said door and enclosed in a housing;

said door is coupled to a side of said security enclosure by a plate and two sets of hinges, a first set and a second set, said hinges disposed inside said security enclosure, said door pivotally mounted on said first set of hinges coupled to the plate at two locations, a first location between the top edge of said door and a top edge of the housing, and a second location between the bottom edge of said door and a bottom edge of the housing, the opposite side of said plate being pivotally mounted on said second set of hinges which are coupled to said security enclosure.

2. The security enclosure and locking mechanism defined by claim 1 wherein the input mechanism electrical signal generating means comprises a keypad and a logic circuit which generates the electrical signal when the predetermined code is entered.

3. The security enclosure and locking mechanism defined by claim 1 wherein the first locking mechanism comprises a solenoid coupled to a logic circuit, the solenoid being adapted to receive said electrical signal and activate when said electrical signal is in a predetermined state.

4. The security enclosure and locking mechanism defined by claim 1 wherein said door, when it is in a closed position, is recessed so that the outside surface of said door lies in the same plane as the front facing surface of the enclosure.

5. The security enclosure and locking mechanism defined by claim 1 wherein said door is coupled to a side of said security enclosure by a plate and two sets of hinges, said hinges disposed inside said security enclosure, said door pivotally mounted on one set of hinges coupled to the plate, the opposite side of said plate being pivotally mounted on said second set of hinges which are coupled to said security enclosure.

6. The security enclosure and locking mechanism defined by claim 1 wherein a flange is coupled to said topside, bottom side, right side, and left side of said enclosure.

7. The security enclosure and locking mechanism defined by claim 6 wherein the top and bottom strike features interlock with the flange on said top side and bottom side of said enclosure.

8. The security enclosure and locking mechanism defined by claim 6 wherein at least one strike feature interlocks with the flange located on the left side of the security enclosure, at least one strike feature interlocks with the flange on the right side of said security enclosure, at least one strike feature interlocks with the flange located on the topside of said security enclosure, and at least one strike feature interlocks with the flange located on the bottom side of the security enclosure.

* * * * *